US009108757B2

(12) United States Patent
Paredes et al.

(10) Patent No.: US 9,108,757 B2
(45) Date of Patent: Aug. 18, 2015

(54) CONTAINER WITH POUR SPOUT

(76) Inventors: Raul M. Paredes, Perrysburg, OH (US); Anthony S. Cohen, Cincinnati, OH (US); Stephen A. Speaker, Cincinnati, OH (US)

( * ) Notice: Subject to any disclaimer, the term of this patent is extended or adjusted under 35 U.S.C. 154(b) by 270 days.

(21) Appl. No.: 13/284,520

(22) Filed: Oct. 28, 2011

(65) Prior Publication Data

US 2013/0105432 A1 May 2, 2013

(51) Int. Cl.

| | |
|---|---|
| ***B65D 1/02*** | (2006.01) |
| ***B65D 25/42*** | (2006.01) |
| ***B65D 23/06*** | (2006.01) |
| ***B65D 23/10*** | (2006.01) |

(52) U.S. Cl.

CPC ..... *B65D 1/023* (2013.01); *B65D 23/06* (2013.01); *B65D 23/102* (2013.01); *B65D 2203/00* (2013.01); *B65D 2501/009* (2013.01)

(58) Field of Classification Search

CPC ..... B65D 23/06; B65D 2543/00092; B65D 25/42; B65D 25/48; B44D 3/12; B44D 3/128

USPC ..... 222/560, 572, 575, 44, 567, 566, 109, 222/564; 215/44, 43, 41, 384, 398; 220/675

See application file for complete search history.

(56) References Cited

U.S. PATENT DOCUMENTS

| | | | | | |
|---|---|---|---|---|---|
| 507,410 | A | * | 10/1893 | Brashear | 241/299 |
| 1,108,023 | A | | 8/1914 | Texter | |
| 1,421,696 | A | * | 7/1922 | Kucera | 222/572 |
| 1,814,659 | A | | 7/1931 | Barroll | |
| 1,925,913 | A | * | 9/1933 | Wood | 222/571 |
| 2,035,877 | A | * | 3/1936 | Geerlings | 215/43 |
| 2,039,345 | A | * | 5/1936 | Ravenscroft | 215/44 |
| 2,057,745 | A | * | 10/1936 | Scheyer et al. | 222/567 |
| 2,059,910 | A | * | 11/1936 | Ravenscroft | 215/41 |
| 2,075,776 | A | | 3/1937 | Barnby | |
| RE20,427 | E | | 6/1937 | Geerlings | |
| 2,099,043 | A | * | 11/1937 | Wicklein | 432/263 |
| 2,135,330 | A | | 11/1938 | Desser | |
| 2,428,588 | A | * | 10/1947 | Schroeder et al. | 222/131 |
| 2,521,523 | A | * | 9/1950 | Kemper | 222/571 |
| 2,688,823 | A | | 9/1954 | Weber | |
| 3,022,916 | A | | 2/1962 | Spooner | |

(Continued)

FOREIGN PATENT DOCUMENTS

WO 2004065249 A1 8/2004

OTHER PUBLICATIONS

International Search Report and Written Opinion, International Application No. PCT/US2012/053075, International Filing Date—Aug. 30, 2012, Mailing Date—Nov. 26, 2012, 12 pages.

*Primary Examiner* — Paul R Durand
*Assistant Examiner* — Charles P Cheyney

(57) ABSTRACT

A container includes a body including a base and a sidewall extending from the base, and a neck finish extending from the body and including a pour spout. The neck finish may include a lower portion adjacent to the body with a cylindrical outer surface and at least one closure engagement feature, and a non-cylindrical portion remote from the body with laterally opposed indents forming the pour spout. The container also may include at least one thickened wall portion extending radially inwardly to form an internal trough to direct flow of product toward the pour spout. The sidewall may include a spout indicator circumferentially corresponding to the pour spout.

38 Claims, 9 Drawing Sheets

(56) References Cited

U.S. PATENT DOCUMENTS

| | | | | | |
|---|---|---|---|---|---|
| 3,235,111 | A | | 2/1966 | Whitton, Jr. et al. | |
| 3,391,838 | A | * | 7/1968 | Gundel | 222/571 |
| 3,400,846 | A | * | 9/1968 | Kelly | 215/398 |
| 3,537,498 | A | * | 11/1970 | St. Amand | 604/403 |
| 3,700,146 | A | * | 10/1972 | Cousins et al. | 222/465.1 |
| 3,738,524 | A | | 6/1973 | Richie | |
| 4,630,761 | A | * | 12/1986 | Thomson | 222/551 |
| 5,065,908 | A | * | 11/1991 | Mengeu | 222/480 |
| 5,372,284 | A | * | 12/1994 | Mock | 222/153.09 |
| D391,159 | S | * | 2/1998 | Sheffler | D9/500 |
| 5,964,383 | A | | 10/1999 | Cargile | |
| 5,988,460 | A | * | 11/1999 | Brecheisen et al. | 222/572 |
| 6,059,153 | A | * | 5/2000 | Olson et al. | 222/465.1 |
| 6,085,949 | A | | 7/2000 | Zimny et al. | |
| 6,609,638 | B1 | * | 8/2003 | Lott | 222/564 |
| 6,695,162 | B1 | * | 2/2004 | Boukobza et al. | 215/384 |
| 6,814,248 | B2 | * | 11/2004 | Beck et al. | 215/384 |
| 6,994,233 | B2 | * | 2/2006 | Dygert et al. | 222/468 |
| 7,770,745 | B2 | | 8/2010 | Weissmann et al. | |
| 8,714,417 | B1 | * | 5/2014 | Szekely | 222/572 |
| 2002/0195471 | A1 | * | 12/2002 | Nottingham et al. | 222/570 |
| 2007/0210123 | A1 | * | 9/2007 | Penny et al. | 222/566 |
| 2007/0235477 | A1 | * | 10/2007 | Penny et al. | 222/566 |
| 2007/0241141 | A1 | * | 10/2007 | Maki et al. | 222/570 |
| 2008/0230573 | A1 | | 9/2008 | Enahoro | |
| 2010/0163515 | A1 | * | 7/2010 | Nemoto | 215/382 |
| 2010/0181278 | A1 | | 7/2010 | Martin | |

* cited by examiner

CONTAINER WITH POUR SPOUT

The present disclosure is directed to containers and, more particularly, to a container with a pour spout.

BACKGROUND AND SUMMARY OF THE DISCLOSURE

Containers often include a body and a neck finish extending axially from the body to accept a closure. The body usually includes a base, a sidewall extending axially away from the base, and a shoulder between the sidewall and the neck finish. The neck finish typically includes circumferentially extending threads or lugs to cooperate with corresponding features of the closure. U.S. Patents that illustrate glass containers of this type include U.S. Pat. Nos. 2,688,823 and 3,738,524.

A general object of the present disclosure, in accordance with one aspect of the disclosure, is to provide a container having a pour spout to direct flow of product through the pour spout and out of the container.

The present disclosure embodies a number of aspects that can be implemented separately from or in combination with each other.

A container in accordance with one aspect of the disclosure includes a body and a neck finish for securement of a closure, the neck finish including a lower portion adjacent to the body, and a non-cylindrical portion remote from the body with laterally opposed indents forming a pour spout.

In accordance with another aspect of the disclosure, there is provided a container that includes a body including a base and a sidewall extending from the base, and a neck finish extending from the body. The neck finish includes a cylindrical portion extending completely circumferentially around the neck finish and having an outer surface and at least one closure engagement feature on the outer surface. The neck finish also includes a non-cylindrical portion extending from the cylindrical portion and including spout walls disposed radially inwardly with respect to the cylindrical portion to form a pour spout. The neck finish further includes ledges disposed between the spout walls and the outer surface of the cylindrical portion.

In accordance with a further aspect of the disclosure, there is provided a container that includes a body including a base and a sidewall extending from the base, a neck finish extending from the body and including a pour spout, and at least one thickened wall portion extending radially inwardly to form an internal trough to direct flow of product toward the pour spout.

In accordance with an additional aspect of the disclosure, there is provided a container that includes a body including a base and a sidewall extending from the base, and a neck finish extending from the body and including a pour spout. The sidewall includes a spout indicator circumferentially corresponding to the pour spout.

BRIEF DESCRIPTION OF THE DRAWINGS

The disclosure, together with additional objects, features, advantages and aspects thereof, will be best understood from the following description, the appended claims and the accompanying drawings, in which:

DETAILED DESCRIPTION OF PREFERRED EMBODIMENTS

Figure 1:
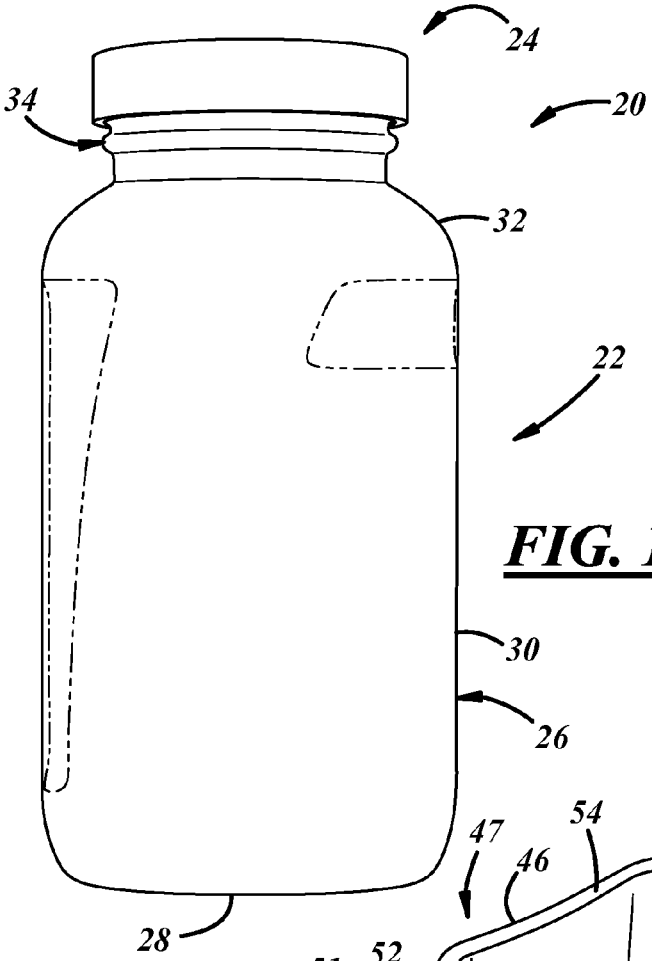
FIG. 1 is an elevational view of a package including a container and a closure in accordance with an illustrative embodiment of the present disclosure.

FIG. 1 illustrates a package 20 including a container 22, and a closure 24 that is coupled to the container 22. The package 20 may be used to package pickles, baby food, salsa, peppers, spaghetti sauces, jams, or any other food products. The package 20 also may be used to package other types of products including but not limited to liquids, gels, powders, particles, and the like.

The container 22 may be composed of glass, or any other material suitable for containing food products. The container 22 may be provided in any suitable sizes, and may be a wide mouth type of container. The container 22 includes a body 26 including a base 28, and a sidewall 30 extending in a direction axially away from the base 28. The body 26 also may include a shoulder 32 extending from the sidewall 30, as illustrated in the Figures. In other embodiments, however, the container body 26 need not include a shoulder. As used herein, directional words such as top, bottom, upper, lower, radial, circumferential, lateral, longitudinal, transverse, vertical, horizontal, and the like are employed by way of description and not limitation.

Figure 2:
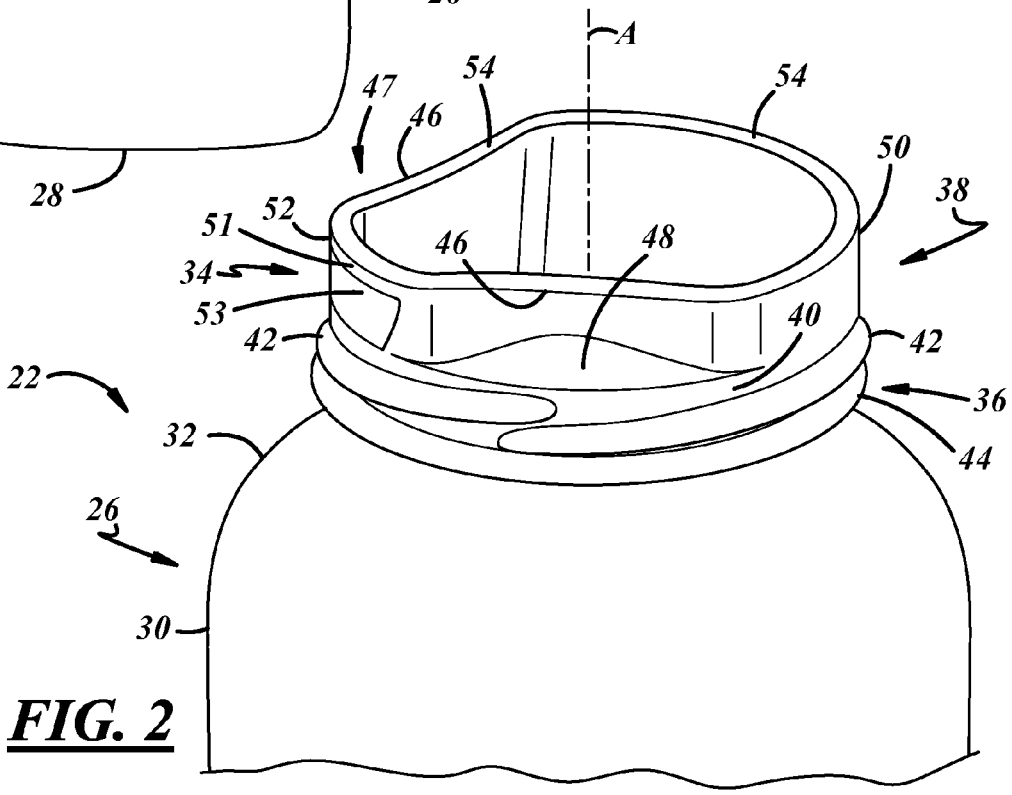
FIG. 2 is an enlarged fragmentary perspective view of the container of FIG. 1.
Figure 3:
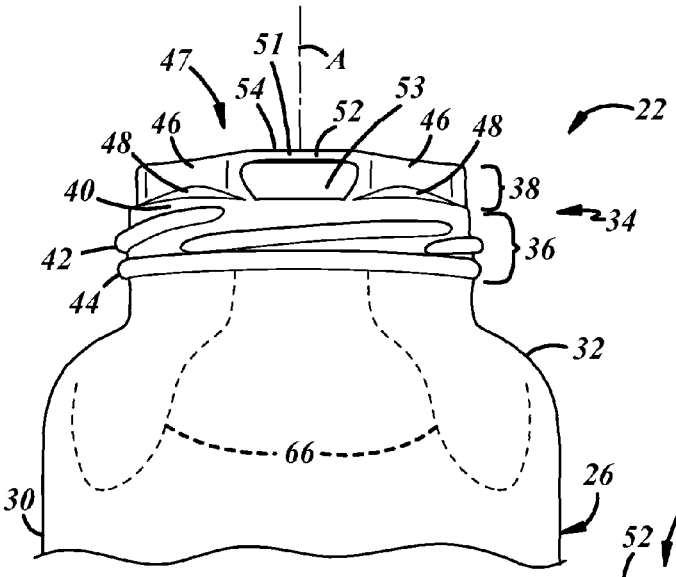
FIG. 3 is an enlarged fragmentary front view of the container of FIG. 1.
Figure 4:
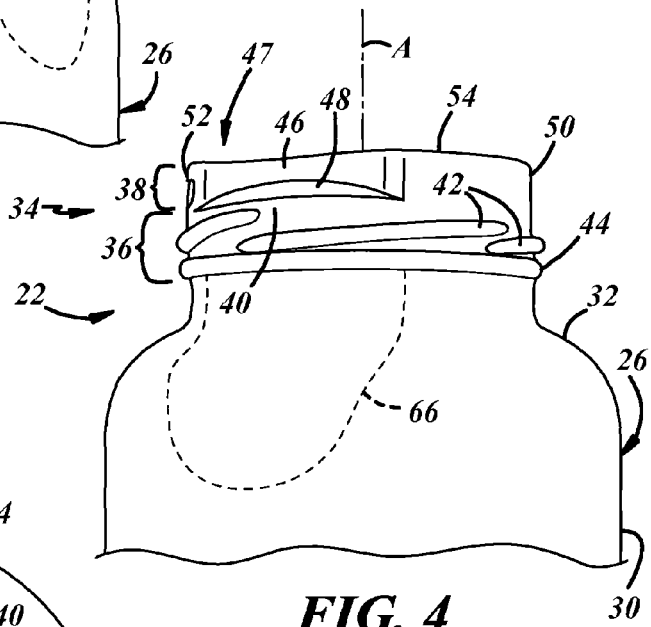
FIG. 4 is an enlarged fragmentary side view of the container of FIG. 1.

Referring to FIGS. 2 through 4, the container 22 also has a first, longitudinal axis A, and includes a neck finish 34 extending from the body 26. More particularly, the neck finish 34 may extend from the shoulder 32 of the sidewall 30. In other embodiments, however, where the container body 26 does not include a shoulder, the neck finish 34 may extend directly from the sidewall 30. The neck finish 34 includes a lower portion 36 and an upper portion 38 remote from the body 26 and extending from the lower portion 36. The lower portion 36 may be cylindrical, and the upper portion 38 may be non-cylindrical.

The lower portion 36 may extend completely circumferentially around the neck finish 34, and has an outer surface 40 and one or more closure engagement features that may include lugs, bayonets, thread segments 42, or any other suitable features, on the outer surface 40. As used herein, the term thread segment includes whole, partial, multiple, and/or an interrupted thread and/or thread segment. The thread segments 42 may include two, three, four, or any suitable quantity of thread segments 42. In any case, the thread segments 42 may extend completely circumferentially around the neck finish 34. The lower portion 36 also may include a capping flange 44 extending completely circumferentially around the neck finish 34 and disposed axially between the thread segments 42 and the body shoulder 32.

Figure 5:
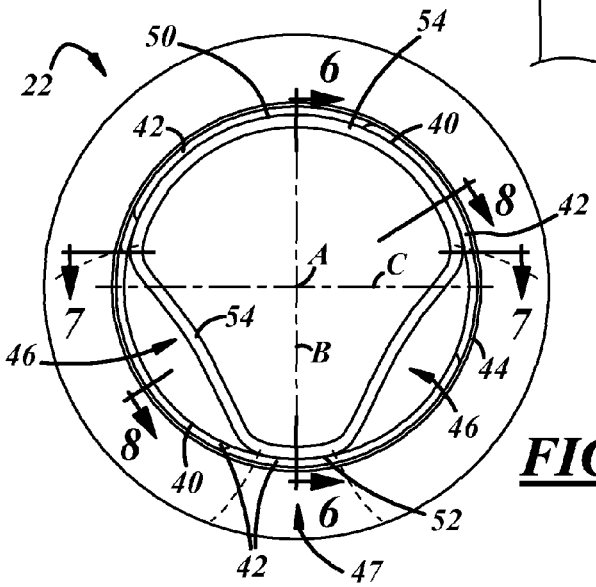
FIG. 5 is an enlarged top view of the container of FIG. 1.

The upper portion 38 includes indents or spout walls 46 disposed radially inwardly with respect to the lower portion 36 and laterally opposed from one another on either side of a second, radial axis B (FIG. 5). The upper portion 38 also may include shoulders or ledges 48 disposed between the spout walls 46 and the outer surface 40 of the lower portion 36. As used herein the term "ledge" generally includes a portion extending transversely to the axis A and adjacent to the higher, more prominent, spout walls 46.

The upper portion 38 also may include a rear wall 50 extending between the spout walls 46 at rear ends of the spout walls 46. The rear wall 50 may be semi-circular or semi-cylindrical in shape and may be an extension of a corresponding portion of the lower portion 36 of the neck finish 34.

The upper portion 38 further may include a trough wall 52 extending circumferentially between the spout walls 46 at forward ends of the spout walls 46, and disposed on an opposite side of a third, transverse radial axis C from the rear wall 50. The trough wall 52 also may be semi-circular or semi-cylindrical in shape and may extend axially from a corresponding part of the lower portion 36 of the neck finish 34. The trough wall 52 may include a lip or projection 51 and a recessed portion 53, for example, to aid in pouring contents from the container 22 in a clean or anti-drip manner. The projection 51 may extend from the sealing surface 54 in an axial direction toward the thread segments 42. The recessed portion 53 may be disposed axially between the projection 51 and the thread segment(s) 42, and the recessed portion 53 may disposed radially inward of a radially outermost portion of the projection 51. For example, a radially outer surface of the projection 51 may have the same radial dimension as a corresponding radially outer surface of the rear wall 50, whereas a radially outer surface of the recessed portion 53 may have a radial dimension that is smaller than the radially outer surfaces of the projection 51 and/or the rear wall 50.

In other embodiments, the rear and trough walls 50, 52 may be of any other suitable shapes. Also, the spout walls 46 alone or together with other portions of the container 22 (e.g. the trough wall 52) may form a pour spout 47.

The walls 46, 50, 52 of the upper portion 38 of the neck finish 34 may terminate in a planar sealing surface 54. At least for the reason that the spout walls 46 may be disposed radially inwardly of the rear wall 50, the planar sealing surface 54 may be non-circular. In particular, the spout walls 46 may be incurvate with respect to the first axis A. Also, the upper portion 38 may be clamshell-shaped when viewed from above the upper portion 38 along the axis A.

One or more of the thread segments 42 may be disposed in a circumferential overlapping relationship with the spout walls 46, the rear wall 50, and the trough wall 52. Accordingly, the securement of the closure 24 may be symmetrical, and uninterrupted or continuous, around the container 22.

Figure 6:
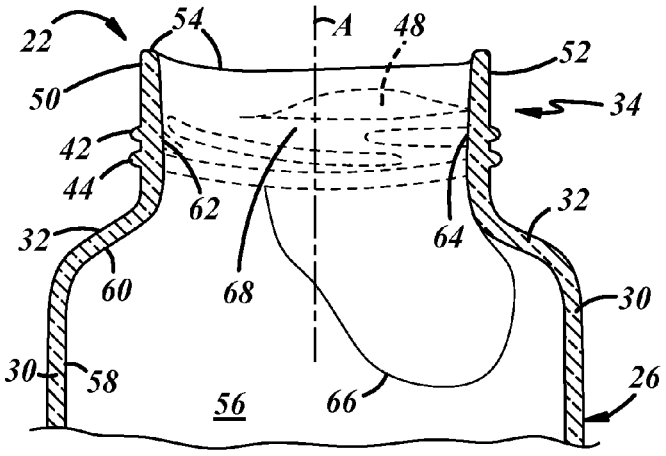
FIG. 6 is a fragmentary sectional view of the container of FIG. 1, taken substantially along line 6-6 of FIG. 5.
Figure 7:
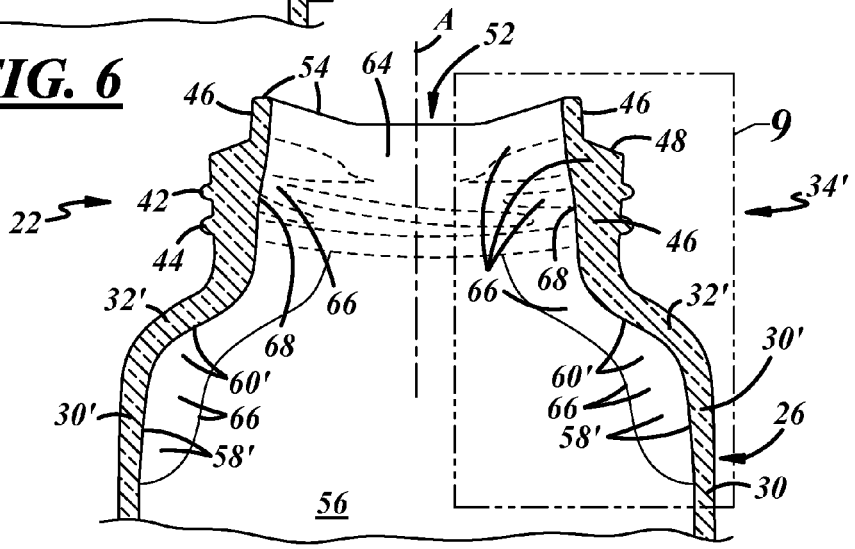
FIG. 7 is a fragmentary sectional view of the container of FIG. 1, taken substantially along line 7-7 of FIG. 5.
Figure 8:
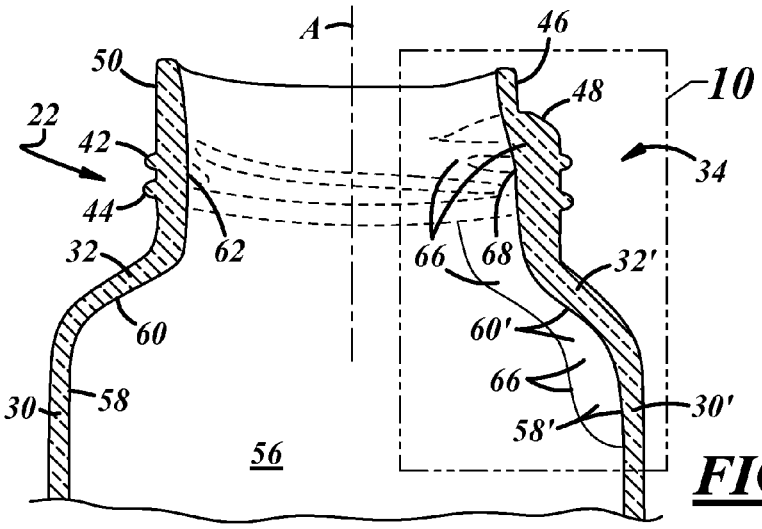
FIG. 8 is a fragmentary sectional view of the container of FIG. 1, taken substantially along line 8-8 of FIG. 5.
Figure 9:
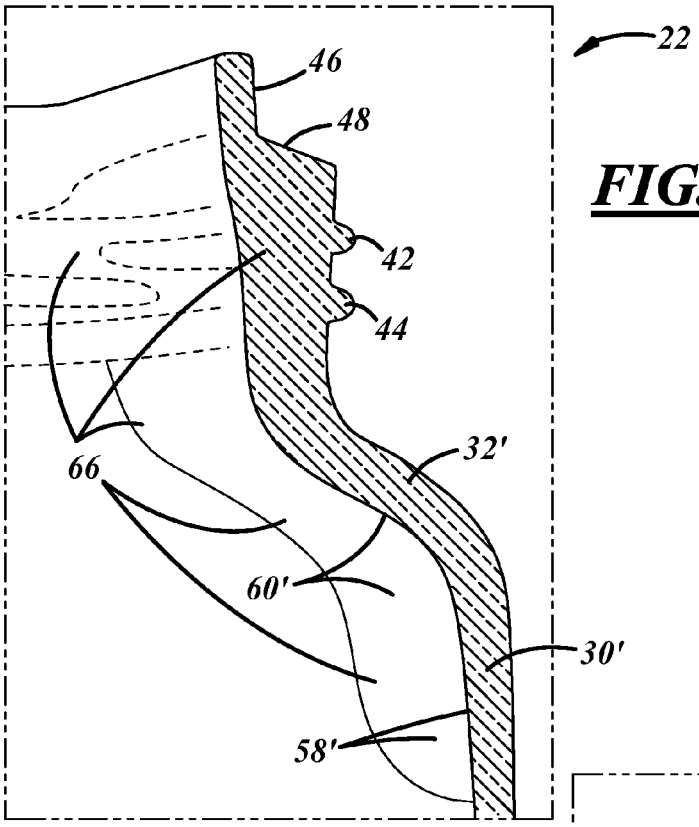
FIG. 9 is an enlarged fragmentary sectional view of a portion of the container of FIG. 1, taken from box 9 of FIG. 7.
Figure 10:
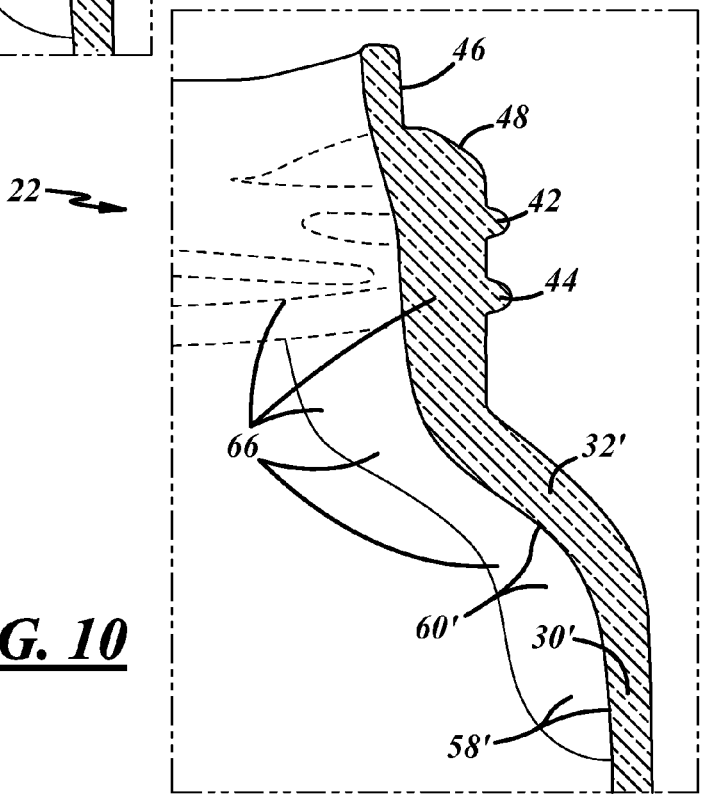
FIG. 10 is an enlarged fragmentary sectional view of a portion of the container of FIG. 1, taken from box 10 of FIG. 8.

Referring to FIG. 6, the container 22 may include an interior 56, a sidewall interior surface 58 of the body sidewall 30, a shoulder interior surface 60 of the body shoulder 32, a rear wall interior surface 62 of the neck finish 34 at a location corresponding to the rear wall 50, and a trough wall interior surface 64 of the neck finish 34 at a location corresponding to the trough wall 52. As shown in FIG. 6, an inside diameter between the rear and trough walls 50, 52, or an inside radius of the interior surface 62 of the neck finish 34, may be greatest at the sealing surface 54 and may be smallest at the lower portion 36 (FIG. 4). Also as shown in FIG. 6, the radial wall thickness of the neck finish 34 at locations corresponding to the rear and trough walls 50, 52 may be the same and may be symmetrical.

Referring to FIGS. 7-10, the container 22 also may include thickened wall portions 66. The thickened wall portions 66 may correspond with the spout walls 46 and may be circumferentially spaced apart. Also, the thickened wall portions 66 may form an internal trough to direct flow of product toward the pour spout between the spout walls 46. The thickened wall portions 66 may be disposed beneath the spout walls 46 or axially between the spout walls 46 and the base 28 of the container 22. Also, the thickened wall portions 66 may be circumferentially aligned with the spout walls 46. The thickened wall portions 66 may extend from the neck finish 34 to the shoulder 32, and may also extend to the sidewall 30.

The container 22 also includes interior surfaces 68 of the container neck finish 34 at locations corresponding to the spout walls 46. The thickened wall portions 66 may include those interior surfaces 68. In addition, the thickened wall portions 66 may form interior surfaces 58' of a thickened body sidewall portion 30' that are disposed radially inward of the interior surfaces 58 of the sidewall 30. The thickened wall portions 66 also may form interior surfaces 60' of a thickened body shoulder portion 32' that are disposed radially inward of the interior surfaces 60 of the shoulder 32. In any case, the thickened wall portions 66 extend radially inwardly, for example toward the axis A with respect to one or more of the interior surfaces 58, 60, 62, 64, to form an internal trough to direct flow of product toward the pour spout.

Figure 11:
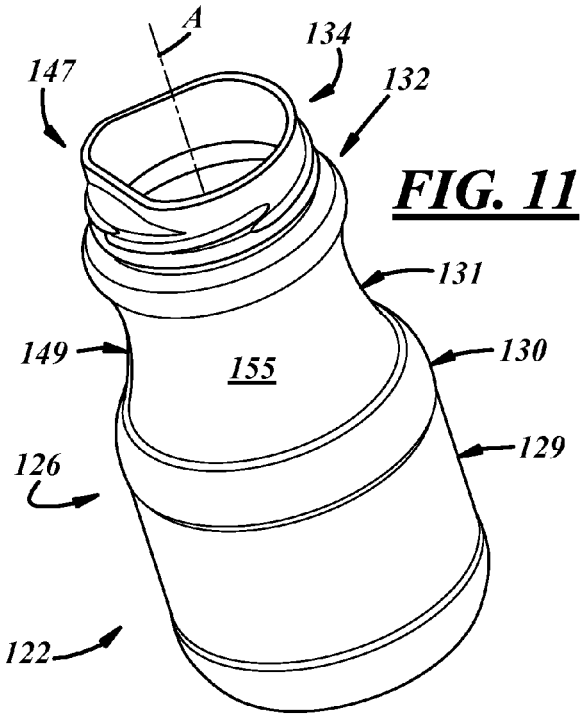
FIG. 11 is a perspective view of a container in accordance with another illustrative embodiment of the present disclosure.
Figure 13:
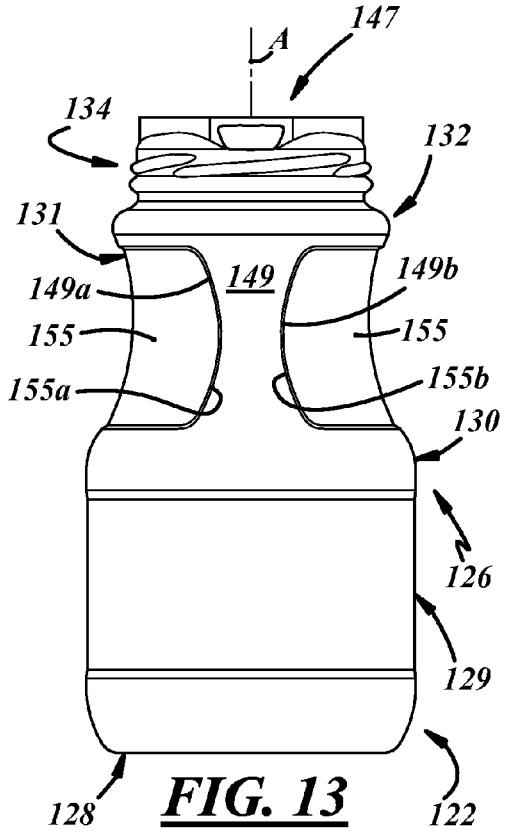
FIG. 13 is a front view of the container of FIG. 11.
Figure 12:
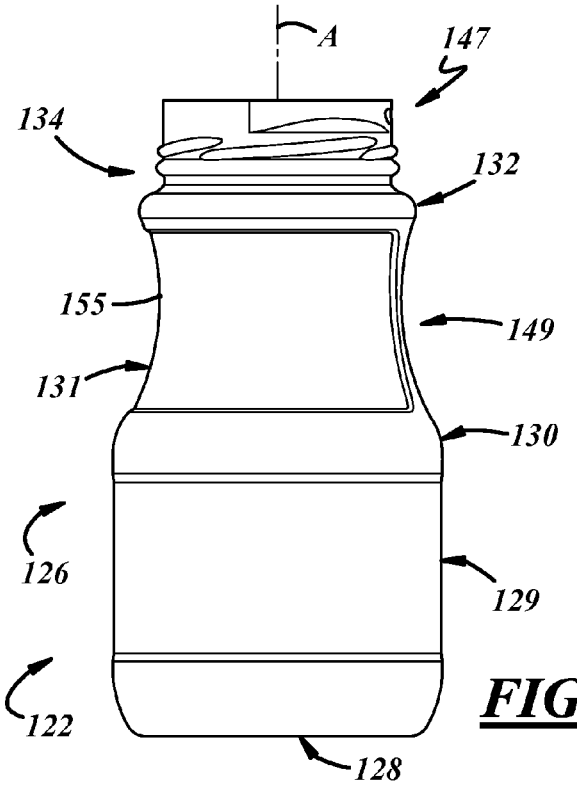
FIG. 12 is a side view of the container of FIG. 11.

FIGS. 11 through 13 illustrate another illustrative embodiment of a container 122. This embodiment is similar in many respects to the embodiments of FIGS. 1-10 and like numerals between the embodiments generally designate like or corresponding elements throughout the several views of the drawing figures. Accordingly, the descriptions of the embodiments are incorporated into one another. Additionally, the description of the common subject matter generally may not be repeated here.

The container 122 includes a body 126 including a base 128, a sidewall 130 extending in a direction axially away from the base 128, and a shoulder 132. The container 122 also has a first, longitudinal axis A, and includes a neck finish 134 extending from the shoulder 132 of the body 126. The neck finish 134 may be the same as that described above with respect to FIGS. 1-10 and, thus, may include a pour spout 147 and may accept the closure 24 illustrated in FIG. 1.

The sidewall 130 includes a spout indicator 149 circumferentially corresponding to the pour spout 147, for instance, to indicate to a user the location of the pour spout 147 when a closure (not shown) applied to the container 122 obscures the circumferential orientation of the pour spout 147. Accordingly, when using the container 122, a user first may see the spout indicator 149 and then grip the container 122 in a suitable location and manner to enable the user to remove the closure and pour contents from the container 122 without having to adjust the user's grip to reorient the pour spout 147. The spout indicator 149 may be circumferentially aligned with the pour spout 147.

The spout indicator 149 may be provided in any suitable manner. For example, the spout indicator 149 may be formed from the same material as the rest of the sidewall 130. More specifically, the spout indicator 149 and the rest of the sidewall 130 may be formed of glass in a glass container manufacturing process. In other examples, the spout indicator 149 may be a separate component separately applied to the sidewall 130.

Referring to FIG. 13, the sidewall 130 may include a grip 155, for instance, to facilitate a good grip of the container 122 and further visually distinguish the spout indicator 149 so as to further enhance a user's ability to quickly spot the spout indicator 149 and begin using the container 122. The grip 155 may extend circumferentially partially around the body 126, may be indented or radially recessed, and may have circumferential ends 155*a*, 155*b* that may define or establish corresponding circumferential portions 149*a*, 149*b* of the spout indicator 149. The circumferential ends 155*a*, 155*b* of the grip 155 may be excurvate in a circumferential direction and the corresponding ends 149*a*, 149*b* of the indicator 149 may be incurvate in a circumferential direction, or vice-versa, or the ends may be straight or of any other suitable shape.

In the embodiment of FIGS. 11-13, the sidewall 130 may include a first portion 129 extending axially from the base 128 and a second portion 131 extending axially between the first portion 129 and the neck finish 134, wherein the second portion 131 may include the spout indicator 149 and the grip 155. The shoulder 132 may extend between the grip 155 and the neck finish 134. Also, the first portion 129 may have a cylindrical outer surface that may be recessed as shown, for instance, to accept a product label, whereas the second portion 131 may have an outer surface that is incurvate in a radial direction, for instance for good gripping by a user.

FIGS. 14 through 17 illustrate another illustrative embodiment of a container 222. This embodiment is similar in many respects to the embodiments of FIGS. 1-13 and like numerals between the embodiments generally designate like or corresponding elements throughout the several views of the drawing figures. Accordingly, the descriptions of the embodiments are incorporated into one another. Additionally, the description of the common subject matter generally may not be repeated here.

Figure 14:
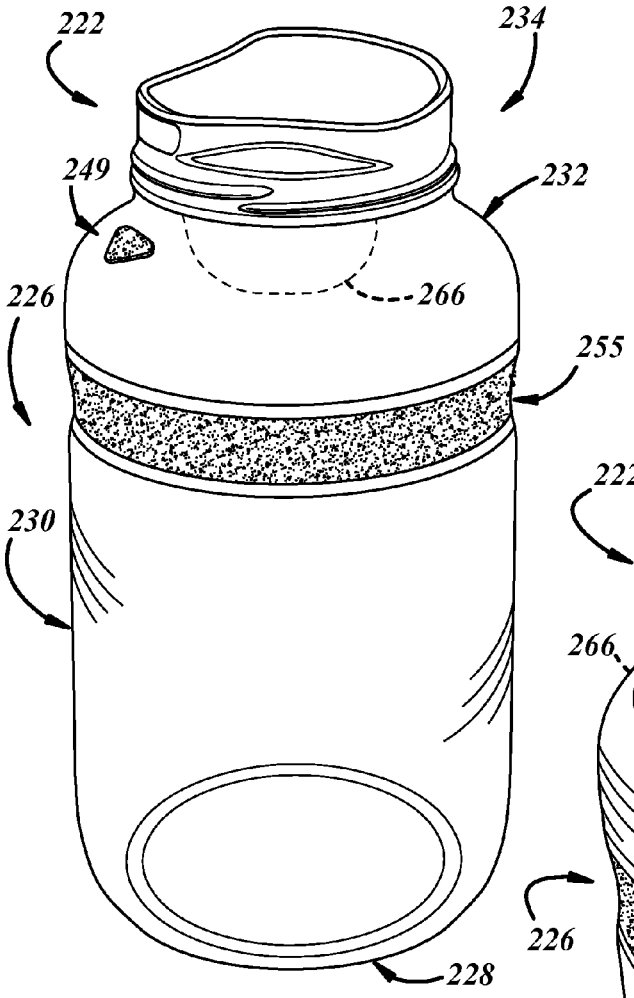
FIG. 14 is a side perspective view of a container in accordance with a further illustrative embodiment of the present disclosure.
Figure 15:
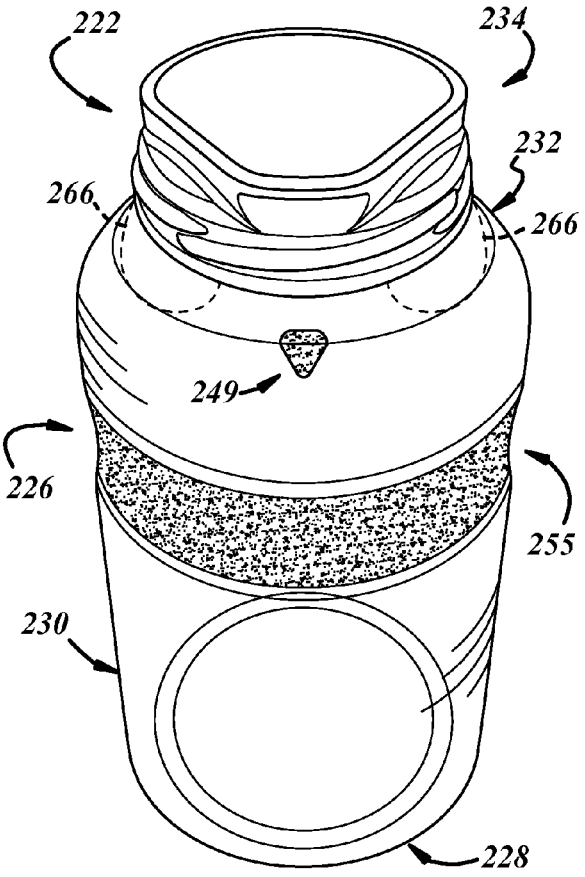
FIG. 15 is a front perspective view of the container of FIG. 14.

With reference to FIGS. 14 and 15, the container 222 includes a body 226 including a base 228, a sidewall 230 extending from the base 228, and a shoulder 232 extending from the sidewall 230, as illustrated in the Figures. The container 222 also may include a neck finish 234 extending from the shoulder 232 of the sidewall 230 of the body 226.

The sidewall 230 may include a spout indicator 249 circumferentially corresponding to the pour spout 247. For example, as best shown in FIG. 15, the spout indicator 249 may be circumferentially aligned with the pour spout 247. Also, the spout indicator 249 may be provided on the shoulder 232. The spout indicator 249 may be generally triangular, for instance, with radiused vertices, as illustrated. The spout indicator 249 may be of the same smooth surface finish as the rest of the body 226 or, as shown, may be textured to provide a surface finish that is coarser than rest of the body 226.

The sidewall 230 also may include a circumferentially extending grip 255. The grip 255 may extend continuously, circumferentially, entirely around the container 222 and may be radially recessed. The grip 255 may be of the same smooth surface finish as the rest of the body 226 or, as shown, may be textured to provide a surface finish that is coarser than rest of the body 226. The grip 255 may be a relatively narrow band, for example, having a width or height less than one-quarter of the height of the body 226. In a more particular example, the height of the grip 255 may be less than one-inch.

As shown in FIGS. 14 and 15, the grip 255 may be bordered by transitions between the outer surface of the sidewall 230 and the grip 255. The shape of the transitions may correspond to the shape of the grip 255 itself. The texture of the transitions may be the same as that of the sidewall 230 in general.

Figure 16:
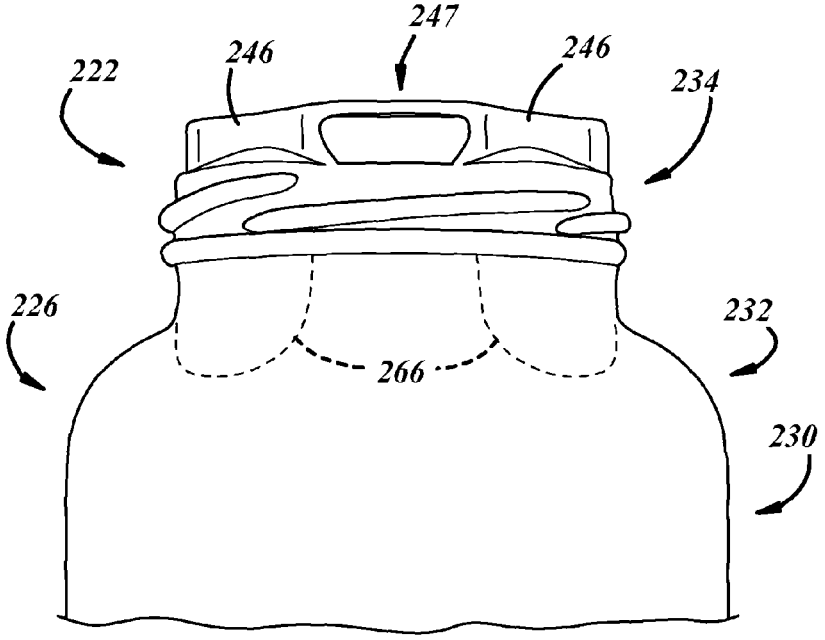
FIG. 16 is an enlarged fragmentary front view of the container of FIG. 14.
Figure 17:
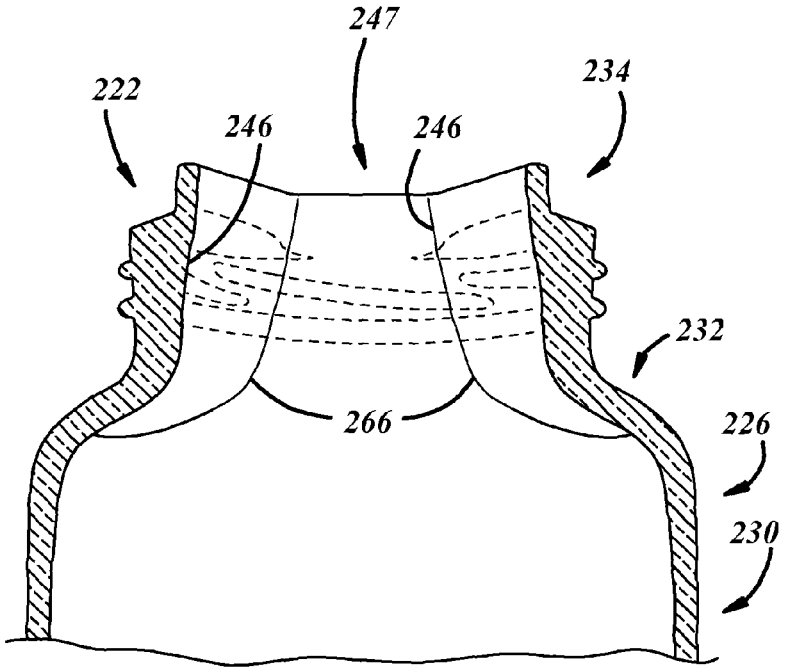
FIG. 17 is a fragmentary sectional view of the container of FIG. 14.

With reference also to FIGS. 16 and 17, the container 222 also may include thickened wall portions 266. The thickened wall portions 266 may correspond with spout walls 246 and may be circumferentially spaced apart to form an internal trough to direct flow of product toward the pour spout 247 between spout walls 246. The thickened wall portions 266 are similar to those described and shown in the previous embodiments, however, they may extend from the spout walls 246 into the neck finish 234 but do not extend below the shoulder 232 down along the sidewall 230 of the body 226. Otherwise, the thickened wall portions 266 may be identical to the previously described thickened wall portions 266.

FIGS. 18 through 21 illustrate another illustrative embodiment of a container 322. This embodiment is similar in many respects to the embodiments of FIGS. 1-17 and like numerals between the embodiments generally designate like or corresponding elements throughout the several views of the drawing figures. Accordingly, the descriptions of the embodiments are incorporated into one another. Additionally, the description of the common subject matter generally may not be repeated here.

Figure 18:
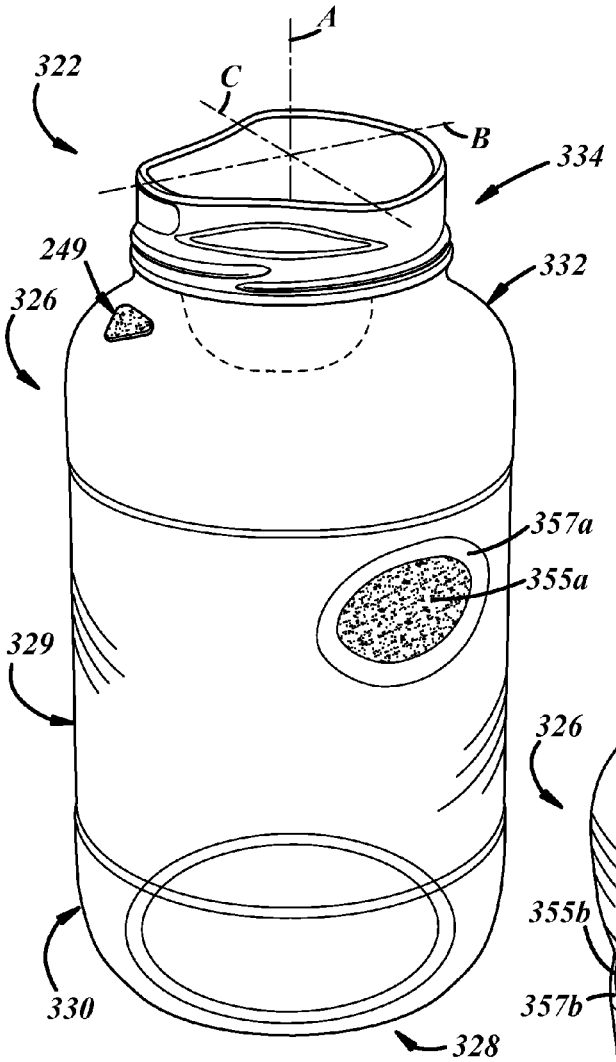
FIG. 18 is a side perspective view of a container in accordance with an additional illustrative embodiment of the present disclosure.
Figure 19:
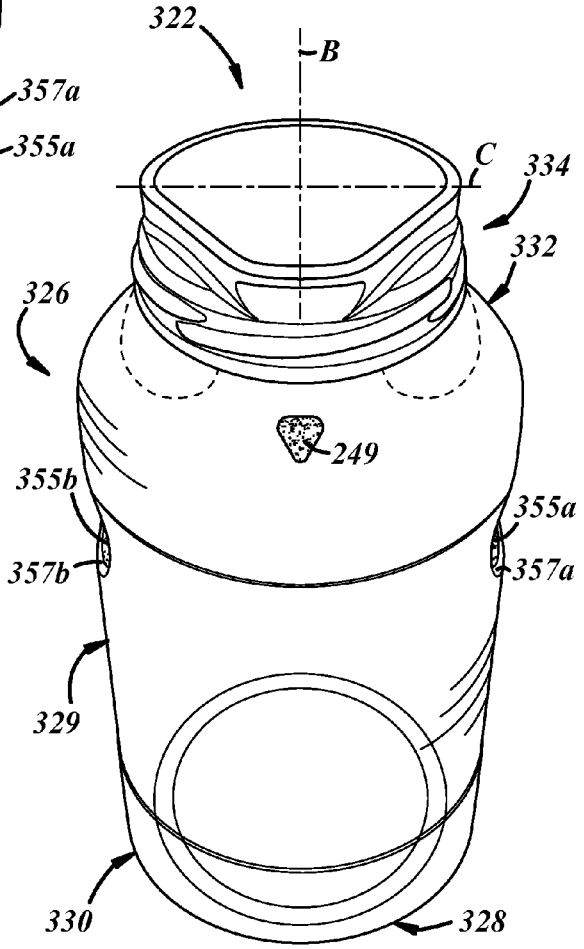
FIG. 19 is a front perspective view of the container of FIG. 18.

With reference to FIGS. 18 and 19, the container 322 includes a body 326 including a base 328, a sidewall 330 extending from the base 328, and a shoulder 332 extending from the sidewall 330, as illustrated in the Figures. The container 322 also includes a neck finish 334 extending from the shoulder 332 of the sidewall 330 of the body 326. The sidewall 330 may include the spout indicator 249 described above with respect to FIGS. 14-17.

Figure 20:
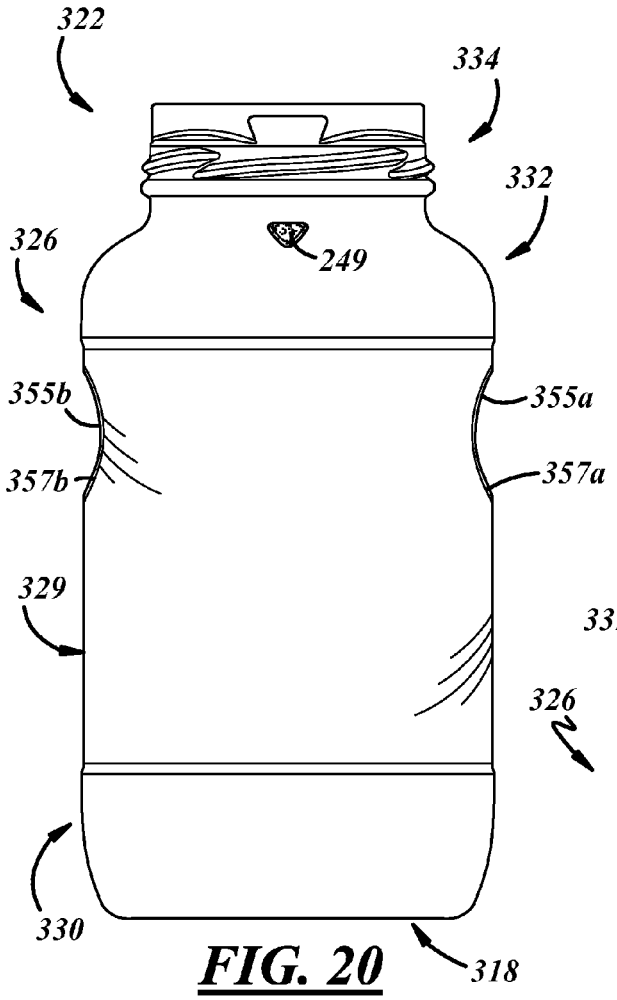
FIG. 20 is a front view of the container of FIG. 18.
Figure 21:
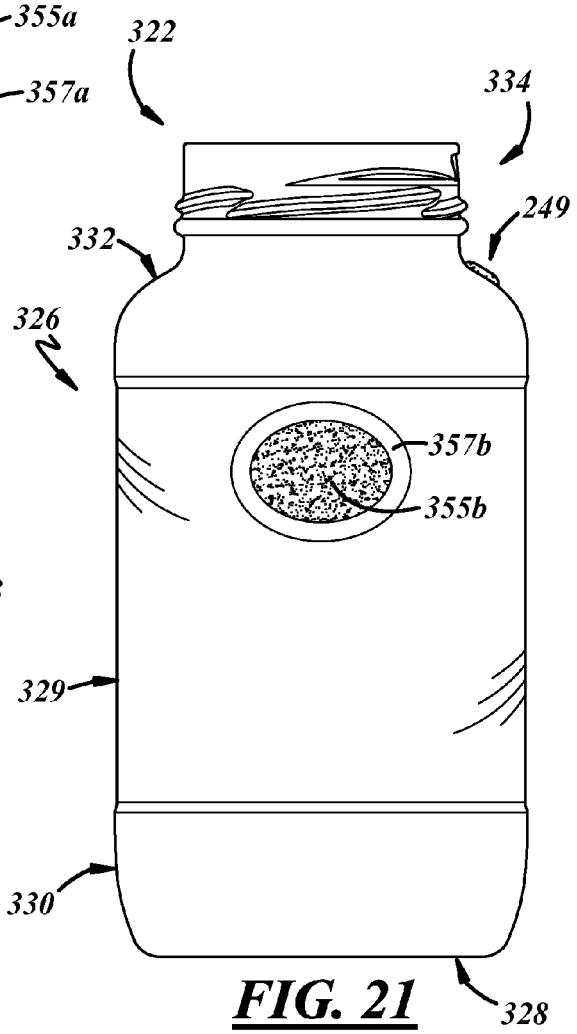
FIG. 21 is a side view of the container of FIG. 18.

Also, the sidewall 330 may include a grip, which may include multiple grip portions, for example, two discrete or individual grip portions 355*a*, 355*b*. The grip portions 355*a*, 355*b* may be disposed on opposite sides of the container body 326, for instance, diametrically opposed from one another on either side of radial axis B as best shown in FIGS. 19 and 20. The grip portions 355*a*, 355*b* may be of the same smooth surface finish as the rest of the body 326 or, as shown, may be textured to provide a surface finish that is coarser than rest of the body 326. The grip portions 355*a*, 355*b* may be generally oval-shaped, for instance, egg-shaped, ellipse-shaped, oblong, or the like, and/or may correspond to an index finger placement and a thumb placement. The grip portions 355*a*, 355*b* may be bordered by transitions 357*a*, 357*b* between the outer surface of the sidewall 330 and the grip portions 355*a*, 355*b*. The shape of the transitions 357*a*, 357*b* may correspond to the shape of the grip portions 355*a*, 355*b*. The texture of the transitions 357*a*, 357*b* may be the same as that of the sidewall 330 in general.

The sidewall 330 may have an outer surface portion 329 that may be recessed as shown, for instance, to accept a product label. The grip portions 355*a*, 355*b* may be provided in the recessed portion 329.

There thus has been disclosed containers that may provide improved product flow and that fully satisfies all of the objects and aims previously set forth. The disclosure has been presented in conjunction with several illustrative embodiments, and additional modifications and variations have been discussed. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. A glass container having a body and a neck finish for securement of a closure, said neck finish including a lower portion adjacent to said body, and a non-cylindrical portion remote from said body with laterally opposed indents forming a pour spout wherein said lower portion of said neck finish is thicker axially beneath said indents than it is at a location that is circumferentially spaced from said indents and both axially beneath and circumferentially aligned with said spout, said thicker lower portion enhancing operation of said pour spout, wherein said non-cylindrical portion of said neck finish terminates in a non-circular planar sealing surface, and includes a rear wall extending circumferentially between said spout walls at rear ends of said spout walls and a trough wall extending between said spout walls at forward ends of said spout walls and wherein an inside diameter between said rear and trough walls and an inside radius of an interior surface of said neck finish is greatest at said sealing surface, and wherein said sealing surface is disposed in a plane perpendicular to a longitudinal axis of the container and is circumferentially continuous.

2. The container set forth in claim 1 wherein said lower portion includes a cylindrical outer surface and at least one closure engagement feature on said outer surface.

3. The container set forth in claim 1 wherein said body includes a base, a sidewall extending from said base, and a shoulder adjacent to said neck finish, and wherein said thicker lower portion extends into said shoulder of said container.

4. The container set forth in claim 1 wherein said body includes a base and a sidewall extending from said base, and wherein said thicker lower portion extends down along interior surfaces of said sidewall of said container and projects radially inwardly of the sidewall interior surfaces.

5. The container set forth in claim 1 wherein said upper portion of said neck finish has a planar non-circular sealing surface remote from said body.

6. The container set forth in claim 1 wherein said spout includes spout walls, and said a trough wall extends circumferentially between ends of said spout walls, extends axially from a corresponding part of said lower portion of said neck finish, and includes a projection and a recessed portion disposed axially between said projection and said at least one closure engagement feature and radially inward with respect to said projection.

7. The container set forth in claim 1 wherein said body includes a spout indicator circumferentially corresponding to said pour spout.

8. The container set forth in claim 7 wherein said spout indicator is circumferentially aligned with said pour spout.

9. The container set forth in claim 7 wherein said body includes a sidewall, and a shoulder from which said neck finish extends, and wherein said spout indicator is on said shoulder.

10. The container set forth in claim 7 wherein said spout indicator is triangular.

11. The container set forth in claim 7 wherein said spout indicator is textured to provide a surface finish that is coarser than the rest of said body.

12. The container set forth in claim 1 wherein said body includes a grip.

13. The container set forth in claim 12 wherein said grip is radially recessed, extends circumferentially partially around said body, and has circumferential ends establishing a spout indicator.

14. The container set forth in claim 12 wherein said grip extends circumferentially entirely around said body.

15. The container set forth in claim 12 wherein said grip is radially recessed.

16. The container set forth in claim 12 wherein said grip is textured to provide a surface finish coarser than that of the rest of the body.

17. The container set forth in claim 12 wherein said grip has a height less than one-quarter of the height of the body.

18. The container set forth in claim 12 wherein said grip includes grip portions disposed on opposite sides of the container body.

19. The container set forth in claim 12 wherein said grip includes two individual grip portions diametrically opposed from one another.

20. The container set forth in claim 18 wherein said grip portions are generally oval-shaped.

21. The container set forth in claim 12 wherein said grip is bordered by a transition between an outer surface of said sidewall and said grip.

22. The container set forth in claim 18 wherein said sidewall has a recessed outer surface portion, and said grip portions are provided in said recessed outer surface portion.

23. A glass container that includes:

a body including a base and a sidewall extending from said base and a shoulder extending from said sidewall; and a neck finish extending from said body and including a cylindrical portion extending completely circumferentially around said neck finish and having an outer surface and at least one closure engagement feature on said outer surface, and a capping flange disposed axially between said at least one closure engagement feature and said body shoulder and extending completely circumferentially around said outer surface of said cylindrical portion, a non-cylindrical portion extending from said cylindrical portion and including spout walls disposed radially inwardly with respect to said cylindrical portion to form a pour spout, and ledges disposed between said spout walls and said outer surface of said cylindrical portion, wherein said non-cylindrical portion of said neck finish terminates in a non-circular planar sealing surface, and includes a rear wall extending circumferentially between said spout walls at rear ends of said spout walls and a trough wall extending between said spout walls at forward ends of said spout walls and wherein an inside diameter between said rear and trough walls and an inside radius of an interior surface of said neck finish is greatest at said sealing surface, and wherein said sealing surface is disposed in a plane perpendicular to a longitudinal axis of the container and is circumferentially continuous.

24. The container set forth in claim 23, wherein said at least one closure engagement feature is disposed axially between said ledges and said body shoulder and is also disposed in a circumferential overlapping relationship with said spout walls.

25. The container set forth in claim 24 wherein said at least one closure engagement feature includes a plurality of thread segments extending completely circumferentially around said neck finish.

26. The container set forth in claim 23 wherein said sealing surface is non-circular viewed from above including said spout walls and said rear wall is semi-cylindrical from said rear ends of said spout walls.

27. The container set forth in claim 23 wherein said neck finish includes an interior surface and said container also includes thickened wall portions corresponding to said spout walls and extending radially inwardly and forming an internal trough to direct flow of product toward said pour spout between said spout walls.

28. The container set forth in claim 27 wherein said body includes an interior, said neck finish includes a neck finish interior surface, said sidewall includes a sidewall interior surface, and said thickened wall portions include interior surfaces disposed radially inwardly of said neck finish interior surface and radially inwardly of the sidewall interior surface.

29. The container set forth in claim 28 wherein said body also includes a shoulder between said sidewall and said neck finish, and said thickened wall portions extend from said neck finish to said shoulder.

30. The container set forth in claim 28 wherein said thickened wall portions extend from said neck finish to said sidewall and further extend down along, and radially inward with respect to, said sidewall interior surface.

31. The container set forth in claim 23 wherein said non-cylindrical portion includes a trough wall which extends circumferentially between ends of said spout walls, extends axially from a corresponding part of said neck finish, and includes a projection and a recessed portion disposed axially between said projection and said at least one closure engagement feature and disposed radially inward with respect to said projection.

32. The container set forth in claim 23 wherein said body includes a spout indicator circumferentially corresponding to said pour spout.

33. The container set forth in claim 32 wherein said spout indicator is circumferentially aligned with said pour spout.

34. The container set forth in claim 32 wherein said body includes a grip.

35. The container set forth in claim 34 wherein said grip has circumferential ends establishing said spout indicator.

36. A glass container that includes:

a body including a base and a sidewall extending from said base;

a neck finish extending from said body and including a pour spout and an interior surface; and circumferentially spaced apart thickened wall portions extending radially inwardly, and including interior surfaces disposed radially inwardly of said neck finish interior surface, to form an internal trough to direct flow of product toward said pour spout, wherein said neck finish includes a non-cylindrical portion that terminates in a non-circular planar sealing surface, and includes spout walls corresponding to said thickened wall portions, a rear wall extending circumferentially between said spout walls at rear ends of said spout walls, and a trough wall extending between said spout walls at forward ends of said spout walls, and wherein an inside diameter between said rear and trough walls and an inside radius of an interior surface of said neck finish is greatest at said sealing surface, and wherein said sealing surface is disposed in a plane perpendicular to a longitudinal axis of the container and is circumferentially continuous.

37. The container set forth in claim 36 wherein said body also includes a shoulder between said sidewall and said neck finish, and said thickened wall portions extend from said neck finish to said shoulder.

38. The container set forth in claim 36 wherein said thickened wall portions extend from said neck finish to said sidewall and further extend down along, and radially inward with respect to, said sidewall interior surface.

* * * * *